US005213259A

United States Patent [19]

Stouffer

[11] Patent Number: 5,213,259

[45] Date of Patent: May 25, 1993

[54] PAINT BOOTH HUMIDITY AND TEMPERATURE CONTROL SYSTEM

[76] Inventor: William D. Stouffer, 1428 South Blvd., Rochester Hills, Mich. 48309

[21] Appl. No.: 768,823

[22] Filed: Sep. 30, 1991

[51] Int. Cl.[5] ..... B01F 3/02

[52] U.S. Cl. ..... 236/44 C; 165/20; 236/46 F; 236/78 C

[58] Field of Search ..... 236/78 C, 46 F, 44 A, 236/44 C; 165/20

[56] References Cited

U.S. PATENT DOCUMENTS

| | | | |
|---|---|---|---|
| 2,554,945 | 5/1951 | Fitzgerald | 236/46 F X |
| 2,574,383 | 11/1951 | Gaddis | 236/46 F X |
| 3,979,535 | 9/1976 | Govindan | 427/422 |
| 4,173,924 | 11/1979 | Bradshaw | 98/115 |
| 4,367,787 | 1/1983 | Bradshaw | 165/35 |
| 4,542,851 | 9/1985 | Itou | 165/20 |
| 4,616,594 | 10/1986 | Itho | 118/326 |

FOREIGN PATENT DOCUMENTS 2140912A 12/1984 United Kingdom ..... 236/44 A

*Primary Examiner*—William E. Wayner

*Attorney, Agent, or Firm*—Charles W. Chandler

[57] ABSTRACT

Humidity control system for regulating the relative humidity of air which is forced through a spray painting booth. The humidity control system employs a water spray nozzle which atomizes water to quickly change the relative humidity and temperature of the ventilation air moving through the paint spray booth. A flow control valve which opens at a predetermined rate to control the water flow to the water spray nozzle in a manner which provides for an overdamped response to changes in the relative humidity level. The humidity control system further includes a motor for operating the flow valve, a controller for energizing the motor, and suitable sensors for providing feedback to the controller. The low predetermined rate at which the flow valve opens allows the water flow through the flow valve to be modulated by the length of time which the motor is energizes.

15 Claims, 2 Drawing Sheets

PAINT BOOTH HUMIDITY AND TEMPERATURE CONTROL SYSTEM

BACKGROUND OF THE INVENTION

1. Field of the Invention

The present invention generally relates to humidity control systems employed to maintain a desired relative humidity level during a particular process. More specifically, this invention relates to a humidity and temperature control system adapted for maintaining a predetermined relative humidity and temperature level within a paint spray booth during the painting of automobile bodies.

2. Description of the Prior Art

Until recently, solvent-based paints have been the preferred paint for applications in the automotive industry, such as the spray painting of automobile bodies, appliances and fiberglass finishing. Such spray painting is conducted within an enclosed spray booth to prevent paint overspray solids and solvents from contaminating other areas of a manufacturing facility, while also preventing entry of air-borne particles. To prevent accumulation of paint overspray within the paint spray both, outside air is forced through the enclosure and vented to atmosphere. The ventilation systems must have the capacity to move sufficiently large volumes of air to keep the accumulation of paint overspray to a minimum.

In response to environmental concerns, both manufacturers and federal regulators have begun to emphasize the use of water-based paints. The conversion to water-based paints has been mandated to some degree by federal regulations which have imposed restrictions on the emission of volatile organic compounds, such as hydrocarbons, which are present in solvent-based paints. As a result, water-based paints have become even more attractive for use within the automotive industry.

However, a disadvantage with water-based paints is their limited ability to produce a satisfactory finish unless the proper conditions are maintained within the paint spray booth. In large part, this drawback is due to the tendency for the water component of a water-based paint to evaporate before the water-borne paint particles come in contact with the surface to be covered. Accordingly, the paint particles reach the surface in a substantially dry form, making it practically impossible to produce an acceptable surface finish. As a consequence, the ventilation air which is forced through the spray paint booth must be humidified sufficiently to prevent the water component of the water-based paint from evaporating prior to contacting the desired surface.

Various approaches have been suggested to provide a suitable humidity control system, many of which include some form of air conditioner or heat exchanger having both a heating and cooling capability to regulate the temperature and relative humidity of the ventilation air, such as that disclosed in U.S. Pat. No. 4,616,594 to Itho. In contrast, U.S. Pat. No. 3,979,535 to Govindan teaches the direct spraying of water or steam into the ventilation air, though how the control system taught by Govindan is able to handle the rapid changes in temperature and relative humidity due to the use of the direct spray method is not disclosed. Primarily, Govindan is directed to the problem of formulating a water-based paint which is suitably matched to the particular specific relative humidity condition provided in the paint spray booth.

More explicit examples of solutions which address how the temperature and relative humidity are controlled are illustrated in U.S. Pat. Nos. 4,173,924 and 4,367,787 to Bradshaw. The former teaches the use of a bank of water spray nozzles which are directed at a first heat exchanger from which the water evaporates to saturate the air passing through the heat exchanger. A single pair of sensors are employed, one being a wet-bulb temperature sensor located immediately downstream of the first heat exchanger and the second being a dry-bulb temperature sensor located downstream from a reheating heat exchanger which reheats the air after it leaves the first heat exchanger.

The later Bradshaw Patent also uses water spray nozzles which spray water onto a heat exchanger. But in contrast, there is disclosed, in combination with a bypass duct, the use of a pair of sensors which are located both upstream and downstream of the heat exchanger. The feedback from the sensors is provided to a controller to suitably adjust the amount of air bypassed around the temperature and humidity devices through the bypass duct. The desired relative humidity of the air is thereby controlled by the amount of air bypassed through the bypass duct.

The above systems generally teach a complicated series of humidifying-cooling/reheating steps, including heat exchangers for recapturing heat downstream of the paint spray both, in order to achieve the desired temperature and relative humidity levels. Such an approach is expensive, requiring a vast array of valves, pipes and electrically-powered heat exchangers which are rather complicated and expensive to maintain. Moreover, such systems require a rather complicated control system to synchronize all of the devices.

Further complicating a control system used under these circumstances is its ability to bring the system up to, and thereafter maintained at, the desired conditions while a large volume of air is rapidly traveling through the air ducts and the paint spray booth. The above-described approaches avoid one source of difficulty by using air conditioners and heat exchangers which react relatively slowly to commands from the control system. This relative insensitivity avoids any rapid changes in the relative humidity level of the ventilation air, which would be sensed almost immediately by the humidity sensor and then fed back to the controller. Sudden changes in humidity would require a correspondingly quick modification in the controller's signal to the humidifying device which, coupled with subsequent rapid changes in relative humidity in response to the modified signal, would cause the system to become unstable and cycle uncontrollably about the desired relative humidity level. Accordingly, the approach taught by the prior art is stable, but comes at the cost of rather high expenses associated with the purchase and maintenance of the air conditioner and heat exchanger systems.

Therefore, what is needed is a humidity control system for a paint spray booth which is simplified and less expensive, and yet employs reliable control features which are stable and can maintain the desired temperature and relative humidity conditions in the paint spray booth.

SUMMARY OF THE INVENTION

The present invention provides a humidity control system which employs a water spray nozzle which is able to quickly change the relative humidity and temperature of the ventilation air moving through the paint spray booth without the need for an air conditioner or heat exchanger. A flow device is provided for controlling the water flow to the water spray nozzle in a manner which provides for an overdamped response to changes in the relative humidity level. Of primary importance, the humidity control system is greatly simplified, requiring only a suitable number of water spray nozzles, a flow valve for controlling the flow of water to the spray nozzles, a motor for operating the flow valve, a controller for energizing the motor, and suitable sensors for providing feedback to the controller.

In particular, the humidity control system of the present invention consists of one or more nozzles which are capable of atomizing the water as it is sprayed directly into the ventilation air. The atomized water is rapidly evaporated into the air, increasing the air's relative humidity. A suitably constructed valve regulates the water flow from a pressurized water source to the nozzles. The opening and closing of the valve occurs at a predetermined rate as established by a motor which drives the valve. Downstream from the nozzles is a sensing device for sensing the relative humidity of the air. The sensing device provides a feedback signal which corresponds to the relative humidity level of the humidified air as it enters the paint spray booth.

The feedback signal is relayed to a control device which energizes or de-energizes the motor so as to modulate the opening of the valve. The goal of the controller is to provide a water flow rate through the valve so as to achieve a desired relative humidity level for the humidified air within a predetermined range. Using the feedback signal from the sensing device, the controller determines the error corresponding to the difference between the desired and actual relative humidity levels and sends a corresponding output to the motor operating the valve. However, the controller's output to the motor is not proportioned to a specific flow rate through the valve, as would be commonly done with flow control valves. In contrast, the output is proportioned to a unit of time for which the valve opens at the predetermined rate. In order to provide this approach for modulating the relative humidity of the air, the valve, as determined by the motor, must open at a rate sufficiently slow so as to prevent overshooting the predetermined relative humidity level.

In essence, the rate at which the valve opens must be sufficiently slow such that the control device can send an on/off output signal to the motor in response to the feedback signal from the sensing device. The valve opens up sufficiently slow such that, as the sensing device updates the controller, the controller can eventually command the motor to energize for a "zero" length of time, thus de-energizing the motor and stopping the valve from further opening. In control algorithm terminology, the response of the controller, and thus the humidity control system, is "overdamped" in that the target is not overshot but is approached gradually over a substantial length of time.

An advantage to the humidity control system of the present invention is that a water spray nozzle can be used to directly spray atomized water into the ventilation air, thus providing for an almost immediate change in both relative humidity and temperature of the air without the need for an expensive air conditioner or heat exchanger. The rapid change in relative humidity and temperature caused by the atomized water is attenuated by the slow response of the water valve such that, from the initiation of the humidifying cycle, the relative humidity of the ventilation air is gradually brought up to the desired level without overshooting the target.

Further, the above-described approach to controlling the water flow to the atomizing nozzles can also be applied to a system for controlling the temperature of the ventilation air through a combuster located upstream from the water spray nozzles. Fuel flow to the combuster can be controlled to the combuster with a similar valve having a predetermined rate of opening which is sufficiently slow such that the controller can control the temperature of the paint spray booth according to the time in which a motor is energized to open the valve, instead of targeting a specific opening of the valve itself.

Accordingly, it is an object of the present invention to provide a humidity control system for a paint spray booth which has a simplified approach to regulating the relative humidity of the ventilation air with a minimal number of devices. The present invention accomplishes this object by providing a humidifier device which atomizes water so as to be evaporated directly into the ventilation air without the need for an air conditioner or heat exchanger.

It is a further object of this invention to provide a controller which regulates the flow of water to the humidifier device so as to regulate the relative humidity of the ventilation air through a motor which opens a valve at a predetermined rate that is sufficiently slow so as to allow the controller to regulate the water flow through the time at which the motor is energized to open the valve.

It is still a further object of this invention to provide a humidity control system which uses a single relative humidity sensor for providing a feedback signal to the controller for computing the length of time to energize the motor opening the valve.

It is yet a further object of this invention to provide a temperature control system which employs the same control approach as the aforementioned humidity control system to regulate the temperature of the ventilation air. The present invention accomplishes this object by providing a combuster device which heats the ventilation air upstream of the humidifier device without the need for an air conditioner or heat exchanger.

It is still another object of this invention that the aforementioned humidity and temperature control systems be substantially stable when rapid changes in relative humidity and temperature are encountered such that the systems' responses are sufficiently slow so as to be overdamped.

Other objects and advantages of this invention will be more apparent after a reading of the following detailed description taken in conjunction with the drawings provided.

BRIEF DESCRIPTION OF THE DRAWINGS

The description refers to the accompanying drawings in which like reference characters refer to like parts throughout the several views, and in which.

DETAILED DESCRIPTION OF THE PREFERRED EMBODIMENT

Figure 1:
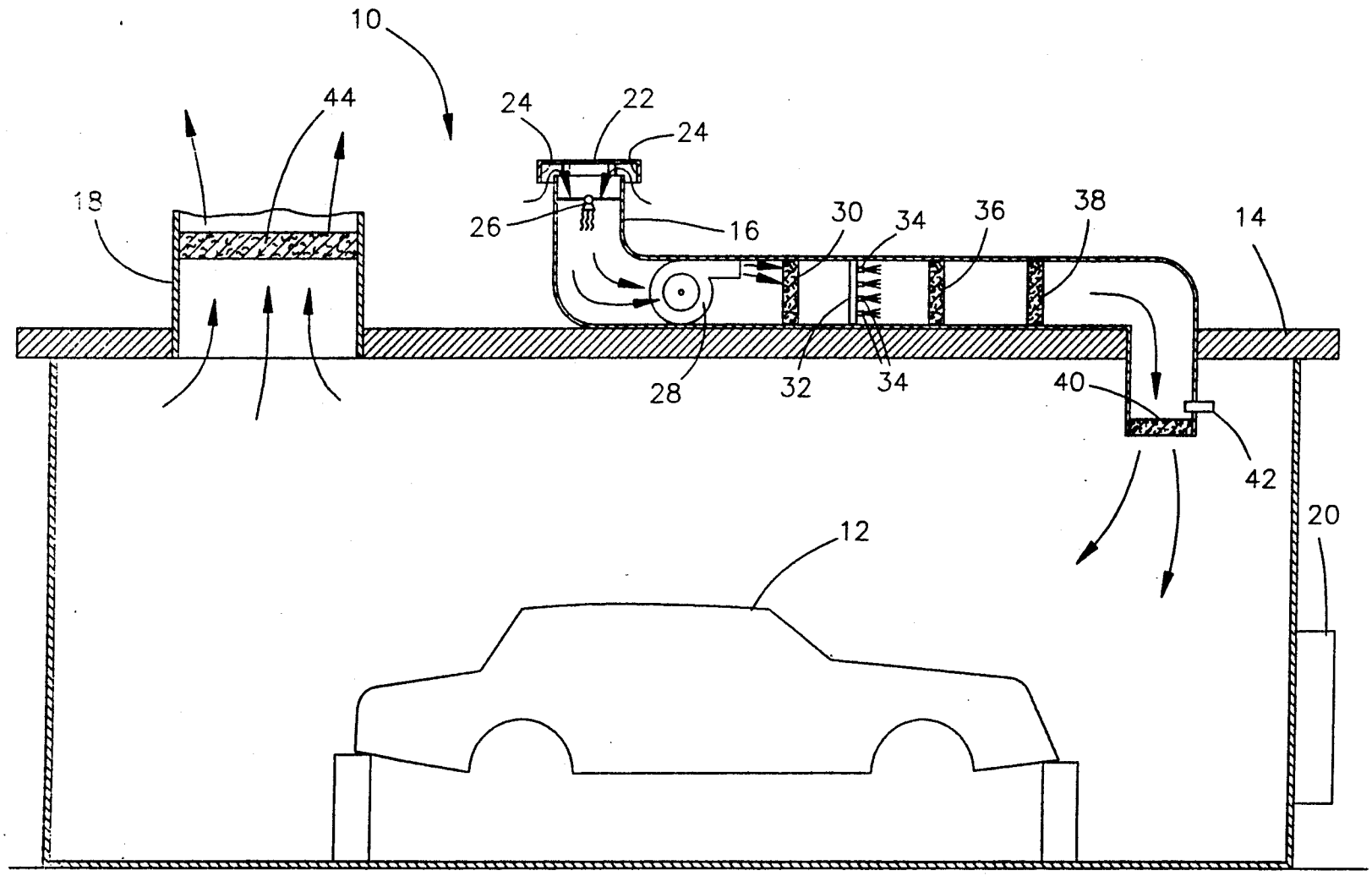
FIG. 1 is a cross-sectional view of a paint spray booth having a humidifier and temperature control system according to the preferred embodiment of the present invention.
Figure 2:
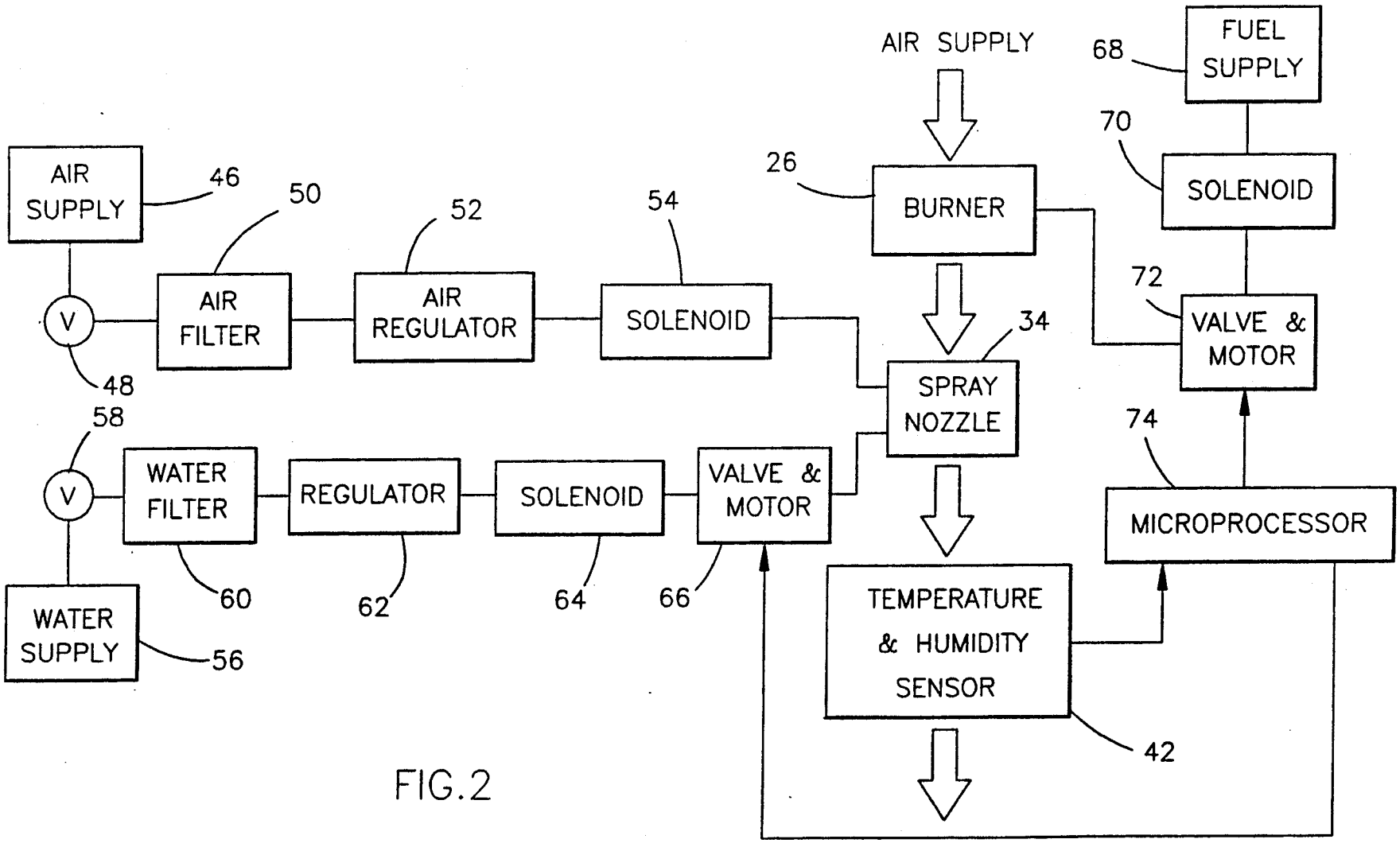
FIG. 2 is a schematic of the control devices employed in the humidifier and temperature control systems of FIG. 1.

Referring to FIGS. 1 and 2, there is provided a paint spray booth 10 having a combuster device, such as a burner 26, and a humidifier device 32 which includes a plurality of water atomizing nozzles 34. Burner 26 is located upstream from humidifier device 32 within a ventilation air supply duct 16, and both are controlled with any suitable controller 20, such as a microprocessor 74 indicated in FIG. 2. In the preferred embodiment, controller 20 regulates the temperature and relative humidity of the ventilation air by controlling burner 26 and humidifier device 32 through a proportional plus integral control algorithm. Controller 20 provides appropriate output signals to burner 26 and humidifier device 32 in response to feedback signals from a temperature and relative humidity sensor unit 42 located in supply duct 16 downstream from both burner 26 and humidifier device 32. The feedback signals are two discrete signals provided by sensor unit 42 which correspond to the actual temperature and relative humidity levels of the ventilation air just prior to entering booth 10.

In FIG. 1, paint spray booth 10 is shown with an automobile body 12 supported therein for the purpose of undergoing a spray painting process utilizing a water-based paint. Accordingly, the temperature and relative humidity of paint spray booth 10 must be accurately controlled to prevent the paint particles from prematurely drying prior to coming in contact with automobile body 12. Supply duct 16 is provided which transports ventilation air into booth 10 from an inlet 24 located above the booth's roofline 14. The ventilation air is vented from booth 10 via a return duct 18, which can direct the ventilation air to any suitable device, such as through a filter 44, for cleansing the ventilation air prior to being returned to the atmosphere.

Supply duct 16 has a rain shroud 22 of any conventional design for preventing rain and any undesirable objects from entering into the system. Alternatively, inlet 24 can be directed downward such that rain cannot fall directly into supply duct 16. Located downstream from inlet 24 is burner 26 of any suitable design. Burner 26 can burn any form of suitable liquid fuel whose flow can be regulated with a fuel valve, which will be described in greater detail below.

Further downstream there is provided a blower 28 of any suitable design which has a sufficient capacity to completely ventilate booth 10. By example, in the preferred embodiment booth 10 is ventilated with an air flow rate of more than 150,000 cubic feet per minute to achieve an air change-over period of less then 15 seconds in booth 10. Further downstream from blower 28 is a primary filter 30 which traps dust and other contaminates, preventing their further passage through supply duct 16 and subsequent entry into booth 10.

Located next in supply duct 16 is humidifier device 32 having nozzles 34 arranged vertically in supply duct 16. It has been determined that nozzles 34 perform most satisfactorily during low water flow periods, such as during initial startup, if the supply pipe which feeds nozzles 34 is oriented vertically so as to be gradually filled with water, thereby progressively initiating flow through each individual nozzle 34. Further explanation of the operation of nozzles 34 will follow.

Further downstream is a humidifier filter 36 and a secondary filter 38 which further filter the ventilation air to prevent contaminants trapped in the atomized water from entering booth 10. An inlet filter 40, located at the outlet of supply duct 16 into booth 10, provides a final barrier to contamination. Just upstream, preferably as close as possible to the outlet of supply duct 16, is sensor unit 42.

With reference now to FIG. 2, nozzle 34 is preferably of the type which uses pressurized air to create a shearing force which encourages the atomizing of the water. Such a nozzle is model number 1727 available the Vortec Corporation of Cincinnati, Ohio, which accepts water pressure of up to 20 psig and is capable of forming a diffused spray of water particles of less than 200 microns in size. Nozzle 34, as provided by the Vortec Corporation, is capable of using pressurized air of up to 200 psig, but in practice has been found to operate satisfactorily with as little as 100 psig, a level commonly available in most available in most manufacturing facilities. The number of nozzles 34 needed for a particular application is dependent upon the desired relative humidity level and air flow capacity of booth 10. Such evaluations and calculations are well within the capability of those skilled in the art, and will not be undertaken here.

As indicated in FIG. 2, both the pressurized air and water are provided to nozzles 34 from suitable sources 46 and 56, respectively. As noted above, an air pressure of 100 psig and water pressure of less than 20 psig have found to be adequate for proper operation of nozzles 34. Accordingly, air supply 46 need not exceed 100 psig for most conditions while water supply 56 need not exceed 20 psig, both being commonly available in a manufacturing facility. Immediately downstream from air supply 46 and water supply 56 are a pair of valves 48 and 58, respectively. Valves 48 and 58 can be hand operated to isolate air supply 46 and water supply 56, respectively, from nozzle 34.

Next in the air flow stream is an air filter 50 and an air regulator 52, each being of any conventional type widely used to clean and regulate pressurized air for laboratory and manufacturing conditions. Similarly, a water filter 60 and a regulator 62 are provided in the water line. Further downstream from regulators 52 and 62 are a corresponding pair of solenoids 54 and 64 which can be electrically controlled from microprocessor 74, as shown, for remote operation by an operator to allow or prevent air and water flow, respectively, to nozzle 34. Alternatively, solenoids 54 and 64 can both be controlled by microprocessor 74, as will be described more fully below.

Downstream from solenoid 64 is a valve and motor combination 66 for regulating the flow of water to nozzle 34. The valve can be of any conventional type which can be operated by a suitable motor, though the valve is preferably capable of nearly linear flow characteristics between its fully closed and fully open positions. In addition, the valve must have sufficient flow capacity in order to provide enough water to nozzles 34 to attain the desired relative humidity level, as noted above. Such a needle valve is manufactured by the Instrumentation Connectors Division of the Parker Hannifin Corporation of Jacksonville, Ala. In addition, this valve is a multiturn valve which allows for slower response by the valve and more accurate control of the water through the valve.

The motor of valve and motor combination 66 is preferably of the rotary actuator-type having a constant output shaft speed of rotation, preferably on the order of approximately 1 rpm. Such an actuator is a available through ETI systems of Oceanside, Calif. The output of the motor is preferred to be constant so as to allow a predetermined rate of opening and closing for the valve. To further slow the response time of the valve, the output of the motor can be further geared down, with speeds of approximately 0.05 rpms being found satisfactory under many conditions. In practice, an overall response time of as much as an hour between the fully closed and fully open positions of the valve have performed very satisfactorily.

Given the proper command from microprocessor 74, valve and motor combination 66 will provide water flow to nozzle 34 which, in cooperation with the pressurized air from air supply 46, provides the atomized spray into supply duct 16. The purpose of such a slow action valve and motor combination 66 is to provide a water flow control device which opens slowly enough to avoid the possibility of overshooting the desired relative humidity level in booth 10. This is important in that the ventilation air flow rate through duct 16 and the humidifying and cooling effect of the atomized water are both rapid enough to produce an almost immediate change in relative humidity as sensed by sensor unit 42. If valve and motor combination 66 were to respond rapidly, the desired relative humidity level would be attained and overshot, causing system instability. Thus, with an extremely slow response valve and motor combination 66, the desired relative humidity level for booth 10 will always be gradually attained in a manner referred to as being overdamped. With the above described control method, a relative humidity for booth 10 has been attainable within 1% of the relative humidity selected.

In much the same manner as the water system described above, fuel is directed to burner 26 from a pressurized fuel supply 68, such as a natural gas source. A solenoid 70 is provided to act as a shutoff valve to a valve and motor combination 72 which preferably is nearly identical to valve and motor combination 66, but for being adapted to handle the fuel. Accordingly, valve and motor 72 provides the system with a flow control device which opens slowly enough to avoid the possibility of overshooting the desired temperature level in booth 10.

As a result, microprocessor 74 can act as a simple on/off device, commanding valve and motor combinations 66 and 72 to each energize for a specific length of time corresponding to the feedback signals received from sensor unit 42. Microprocessor 74 compares the actual temperature and relative humidity levels indicated by sensor unit 42 with the desired temperature and relative humidity levels for the painting process. The difference between the actual and desired levels determines the first output signal to motor 66, which is essentially a command for motor 66 to turn on for a period of time proportional to the error. As a result, the temperature and relative humidity of booth 10 begin to slowly rise due to the extremely slow increase in fuel and water flow, respectively, gradually changing the error detected. With the preferred proportional plus integral control, the outputs of microprocessor 74 to valve and motor combinations 66 and 72 are each a combination of an output proportional to the error, plus an output corresponding to the integral of the error over time. The integral component encourages a faster initial response while ensuring a significantly slower response as the desired temperature and relative humidity levels draw near.

It will be apparent to those skilled in the art that the output of microprocessor 74 to valve and motor combinations 66 and 72 can have delays embedded so as to further slow their corresponding responses. For example, the output of microprocessor 74 can have intermittent interruptions to de-energize the corresponding motor for a particular length of time until a new feedback signal is evaluated. The primary control function of microprocessor 74 will still be served in that the time durations in which the motors of valve and motor combinations 66 and 72 are energized will dictate the response curve of the temperature and humidity control systems.

During startup, an operator will start blower 28 to begin the flow of ventilation air through supply duct 16. The operator will also specify a preferred temperature level and relative humidity level for a particular process. Depending upon circumstances such as the type of water-based paint used, the relative humidity will typically be in the range of 40% to 80% relative humidity while the preferred temperature will often be in the 70° to 75° F. range. At this time, solenoids 54, 64 and 70 may be individually energized to begin the flow of their respective fluids, or the solenoids can be controlled through microprocessor 74 such that they are energized once the command to begin humidifying and heating are given by microprocessor 74. Either way, pressurized air flow to nozzles 34 will begin immediately while flow from fuel supply 68 and water supply 56 will begin very slowly, matching the extremely slow rate at which their corresponding valves open.

Microprocessor 74 will sample the feedback signals from sensing unit 42 in any known manner, such as at intervals of 1 second, at which time it will compare the temperature and relative humidity levels in supply duct 16 downstream from burner 26 and nozzles 34 with the preferred levels as selected by the operator. From this comparison, microprocessor 74 will output separate signals to valve and motor 66 and valve and motor 72 which energize the respective motors for a length of time corresponding to the error signals. Preferably, the length of time energized is greater than the sampling intervals of microprocessor 74 such that the motors are continuously energized until the desired levels are attained. In this manner, as the actual temperature and relative humidity levels reach the desired levels, the time duration which the motors are commanded to be energized becomes increasingly short until the flow rates through the valves meet the demands for achieving the desired levels.

An advantage to the humidity control system of the present invention is that nozzle 34 can be used to directly spray atomized water into the ventilation air. This approach provides a relatively inexpensive and structurally uncomplicated method of humidifying the ventilation air, while also providing an almost immediate change in both relative humidity and temperature of the ventilation air without the need for an air conditioner or heat exchanger. To avoid the unstable influence a rapid change in relative humidity would otherwise have, the response of valve and motor combination 66 is restricted by the predetermined constant rate at which the valve can open. The relative humidity of booth 10 is controlled according to the time in which the motor is energized to open the valve, and not by targeting a specific opening of the valve itself. As a result, the response of the humidity control system is overdamped and, upon the initiation of the humidifying cycle, the relative humidity of the ventilation air is slowly brought up to the desired level without overshooting it.

Another advantage is that the temperature of the ventilation air can also be controlled in much the same manner. Fuel flow to burner 26 is controlled with valve and motor combination 72 having a predetermined rate of opening which is sufficiently slow such that the microprocessor 74 can control the temperature of the booth 10 according to the time in which the motor is energized to open the valve.

While the invention has been described in terms of a preferred embodiment, it is apparent that other forms could be adopted by one skilled in the art. Accordingly, the scope of the invention is to be limited only by the following claims.

Having described my invention, I claim:

1. A humidity control system for a spray painting chamber wherein air which is being forced through a duct to the spray painting chamber is humidified with water from a pressurized water source, the humidity control system comprising:

means for atomizing the water and spraying the atomized water directly into the air as it is forced through the duct such that the water and the air form humidified air having a relative humidity level;

valve means for regulating the flow of the water from the pressurized water source to the means for atomizing the water;

motor means for opening and closing the valve means at a predetermined rate;

means for sensing the relative humidity of the humidified air, the means for sensing being mounted within the duct and downstream from the means for atomizing the water, the means for sensing providing a feedback signal which corresponds to the relative humidity level of the humidified air; and control means for energizing and deenergizing the motor means so as to modulate the time over which the valve means opens and closes at the predetermined rate, the control means operating on the feedback signal of the means for sensing to determine the length of time for which the motor means is energized, the predetermined rate for opening and closing the valve means being sufficiently low such that the response of the humidity control system is overdamped.

2. The humidity control system of claim 1 wherein the predetermined rate at which the valve means is opened or closed is not less than 1 hour between a fully closed position and a fully open position.

3. The humidity control system of claim 1 wherein the motor means has an output shaft which rotates at no more than about one revolution per minute.

4. The humidity control system of claim 1 wherein the control means is a proportional plus integral controller which modulates the time at which the motor means is energized according to the feedback signal of the means for sensing.

5. The humidity control system of claim 1 further comprising a preheat system wherein the air is preheated prior to being humidified, the air being preheated with combuster means which is provided with fuel from a pressurized fuel source, the preheat system comprising:

fuel valve means for regulating the flow of the fuel from the pressurized fuel source to the combuster means;

fuel motor means for opening and closing the fuel valve means at a predetermined rate;

temperature sensing means for sensing the temperature of the humidified air, the temperature sensing means being mounted within the duct and downstream from the means for atomizing the water, the temperature sensing means providing a feedback temperature signal corresponding to the temperature of the humidified air; and fuel control means for energizing and deenergizing the fuel motor means so as to modulate the time over which the fuel valve means opens and closes at the predetermined rate, the fuel control means operating on the feedback temperature signal of the temperature sensing means to determine the length of time for which the fuel motor means is energized, the predetermined rate for opening and closing the fuel valve means being sufficiently low such that the response of the preheat system is overdamped.

6. A humidity control system for a spray painting chamber wherein air being forced through a duct to the spray painting chamber is humidified by a combination of water from a pressurized water source and pressurized air from a pressurized air source, the humidity control system comprising:

nozzle means for atomizing the water, mixing the pressurized air with the atomized water to form a water and air mixture, and spraying the water and air mixture directly into the supply air as it is forced through the duct to form humidified air having a relative humidity level;

valve means for limiting the flow of the water from the pressurized water source to the nozzle means;

motor means for opening and closing the valve means at a predetermined rate;

humidity sensing means mounted within the duct and downstream from the nozzle means, the humidity sensing means providing a feedback signal which corresponds to the relative humidity level of the humidified air; and control means for energizing and deenergizing the motor means so as to modulate the time over which the valve means opens and closes at the predetermined rate, the control means operating on the feedback signal of the humidity sensing means to determine the length of time for which the motor means is energized, the predetermined rate for opening and closing the valve means being sufficiently low such that the response of the humidity control system is overdamped.

7. The humidity control system of claim 6 wherein the predetermined rate at which the valve means is opened or closed is not less than 1 hour between a fully closed position and a fully open position.

8. The humidity control system of claim 6 wherein the motor means has an output shaft which rotates at no more than 1 revolution per minute.

9. The humidity control system of claim 6 wherein the control means is a proportional plus integral controller which modulates the time at which the motor means is energized according to the feedback signal of the humidity sensing means.

10. The humidity control system of claim 6 wherein the water is atomized to produce water particles of less than 200 microns in size.

11. A method for controlling the relative humidity of humidifying air supplied to a spray painting chamber wherein pressurized water is sprayed into supply air being forced through a duct into the spray painting chamber, the method comprising the steps of:

relaying a signal which commands a valve to open at a predetermined rate for a length of time, the extent to which the valve is opened determining the flow rate of the pressurized water into the supply air;

atomizing the pressurized water with a nozzle means located within the duct;

introducing the atomized water into the duct through which the supply air is flowing to form the humidifying air;

sensing the relative humidity level of the humidifying air downstream from the nozzle means;

providing a feedback signal to control means, the feedback signal being derived from the sensed relative humidity level of the humidifying air; and modulating the signal to the valve in response to the feedback signal so as to adjust the length of time which the valve is to open at the predetermined rate, the valve ceasing to open further once the predetermined relative humidity level of the humidified air is attained.

12. The method of claim 11 wherein the step of atomizing the pressurized water includes atomizing the water with pressurized air.

13. A method for controlling the relative humidity of humidifying air supplied to a spray painting chamber wherein pressurized water is combined with pressurized air and sprayed into supply air being forced through a duct into the spray painting chamber, the method comprising the steps of:

sensing the relative humidity level of the humidifying air within the duct;

providing a feedback signal to control means;

providing an output signal from the control means to command a valve to open at a predetermined rate for a length of time corresponding to the feedback signal, the extent to which the valve is opened determining the flow rate of the pressurized water to a nozzle located within the duct;

separately supplying the pressurized air to the nozzle;

mixing the pressurized air and the pressurized water with the nozzle to atomize the pressurized water and form atomized water;

introducing the atomized water into the duct through which the stream of supply air is flowing to form the humidifying air;

sensing the relative humidity level of the humidifying air;

providing a second feedback signal to the control means; and modulating the output signal of the control means to the valve in response to the second feedback signal so as to adjust the length of time over which the valve opens at the predetermined rate, the valve ceasing to open further once the predetermined relative humidity level of the humidified air is attained;

whereby the predetermined rate at which the valve opens is sufficiently low such that the response of the control means is overdamped.

14. The method of claim 13 further comprising the steps of:

relaying a temperature signal corresponding to a predetermined temperature level to command a fuel valve to open at a predetermined rate for a length of time, the extent to which the fuel valve is opened determining the flow rate of fuel to a combuster means located within the duct;

combusting the fuel so as to heat the supply air within the duct;

sensing the temperature of the humidifying air;

providing a temperature feedback signal to control means; and modulating the signal to the fuel valve in response to the temperature feedback signal so as to adjust the length of time over which the fuel valve opens at the predetermined rate, the fuel valve ceasing to open further once the predetermined temperature level of the humidified air is attained;

whereby the predetermined rate at which the fuel valve opens is sufficiently low such that the response of the control means is overdamped.

15. The method of claim 13 further comprising the steps of:

sensing the temperature of the humidifying air within the duct;

providing a temperature feedback signal to the control means;

providing a temperature output signal from the control means to command a fuel valve to open at a predetermined rate for a length of time corresponding to the temperature feedback signal, the extent to which the fuel valve is opened determining the flow rate of fuel to a combuster means located within the duct;

combusting the fuel so as to heat the supply air within the duct;

sensing the temperature of the humidifying air within the duct;

providing a second temperature feedback signal to the control means; and modulating the temperature output signal of the control means to the fuel valve in response to the second temperature feedback signal so as to adjust the length of time over which the fuel valve opens at the predetermined rate, the fuel valve ceasing to open further once the predetermined temperature level of the humidified air is attained;

whereby the predetermined rate at which the fuel valve opens is sufficiently low such that the response of the control means is overdamped.

* * * * *